United States Patent [19]

Sumi et al.

[11] Patent Number: 4,764,177

[45] Date of Patent: Aug. 16, 1988

[54] METHOD OF TRANSFER PRINTING PLASTIC MOLDED ARTICLES HAVING PATTERNS OF CHARACTERS AND/OR SYMBOLS ON THEIR TOP FACES AND FRONT SIDE FACES AND PATTERN IMPARTING MACHINE

[75] Inventors: Takao Sumi, Kyoto; Yoshihide Inako, Nishinomiya; Masahiro Nishida, Ibaraki, all of Japan

[73] Assignee: Nissha Printing Co., Ltd., Kyoto, Japan

[21] Appl. No.: 931,724

[22] PCT Filed: Feb. 26, 1986

[86] PCT No.: PCT/JP86/00092

§ 371 Date: Oct. 27, 1986

§ 102(e) Date: Oct. 27, 1986

[87] PCT Pub. No.: WO86/05145

PCT Pub. Date: Sep. 12, 1986

[30] Foreign Application Priority Data

Feb. 28, 1985 [JP] Japan ..... 60-40696

[51] Int. Cl.[4] ..... B41F 16/00; B41F 1/28; B44C 1/16

[52] U.S. Cl. ..... 8/471; 8/470; 101/407 BP; 156/230; 156/309.9; 156/380.9; 156/541

[58] Field of Search ..... 8/471

[56] References Cited

U.S. PATENT DOCUMENTS 4,516,978 5/1985 Goto et al. ..... 8/510
4,662,966 5/1987 Sumi et al. ..... 8/471

FOREIGN PATENT DOCUMENTS 58-155957 9/1983 Japan .
59-041292 3/1984 Japan .
59-182781 10/1984 Japan .
8605145 9/1986 PCT Int'l Appl. .

*Primary Examiner*—A. Lionel Clingman
*Attorney, Agent, or Firm*—Burns, Doane, Swecker & Mathis

[57] ABSTRACT

A method of making plastics molded articles having patterns of characters and/or symbols on their top and side front faces, wherein, after a transfer sheet having a top face pattern, a front side face pattern and a line of fracture surrounding the front side face pattern has been fixed above a key cap, the top face pattern of the transfer sheet is pressed against and tightly applied to a top face of the key cap by the use of a top pad whereas the front side face pattern of the transfer sheet is pressed against and tightly applied to a front side face while being cut along the line of fracture by the use of a side pad, and a pattern imparting machine convenient for use therein.

10 Claims, 1 Drawing Sheet

METHOD OF TRANSFER PRINTING PLASTIC MOLDED ARTICLES HAVING PATTERNS OF CHARACTERS AND/OR SYMBOLS ON THEIR TOP FACES AND FRONT SIDE FACES AND PATTERN IMPARTING MACHINE

TECHNOLOGY ASSOCIATED WITH THE INVENTION

The present invention relates to a method of making plastic molded articles having patterns of characters and/or symbols on their top faces and front side faces, and a pattern imparting machine. More specifically, it relates to a method of making plastic molded articles having patterns of characters and/or symbols efficiently and with no misprint, and a pattern imparting machine convenient to use therefor.

BACKGROUND ART

As plastic molded articles requiring patterns of characters and/or symbols on their top faces and front side faces, there are generally many products, a representative example of which is a key cap. This key cap is used in a keyboard of, for example, a push-button telephone, a desk top electronic calculator, a typewriter, a word processor, a personal computer and the like. Hereinafter, reference will be made to the key cap as a plastic molded article for the description of the present invention.

Japanese Laid-open Patent Publication No. 58-155957 discloses a transfer printing method utilizing a transfer pad wherein a transfer sheet used for imparting a picture to various articles is used to form a pattern of characters and/or symbols on a key cap matrix surface by dyeing. That method uses a transfer sheet which is a support sheet on which a pattern of characters and/or symbols are formed by the use of an ink containing thermally migrateable dyes. The transfer sheet is placed on a top face of the key cap matrix with the pattern held in contact therewith. The transfer pad is then pressed from the side of the support sheet of the transfer sheet to cause the pattern to tightly contact the surface of the key cap matrix. A heating treatment is subsequently effected while the key cap matrix surface and the pattern are held in tight contact with each other to cause the thermally migrateable dyes within the pattern to be diffused thermally to form a desired pattern of characters and/or symbols on the surface of the key cap matrix. The support sheet is thereafter removed. Since the pattern of characters and/or symbols is formed by dyeing, this method is effective to provide a product excellent in resistance to wear as compared with a so-called direct printing method and is also effective to provide an inexpensive product as compared with a so-called bicolor molding method, and has, therefore, an extreme utility.

TECHNICAL PROBLEMS

However, the above described conventional method is not intended to impart the pattern of characters and/or symbols simultaneously to the top face and the front side face of the key cap and has the following problems.

Key-caps frequently have a number of functions and, therefore, the necessity has arisen to impart a pattern of characters and/or symbols descriptive of these functions not only to the top face, but also to the front side face of the key cap. However, the conventional method is of such a nature that it cannot cope with the new demand. In other words, even though the conventional method is applied in the form as presented, the pattern of characters and/or symbols cannot be formed simultaneously on the top face and the front side face. Therefore, the use has been currently made of a method wherein, while the conventional method is applied only to the top face, a direct printing method is applied to the front side face. Alternatively, a method is used wherein the conventional method of transfer printing to the top face and a transfer printing step to the front side face are separately performed. However, these methods are disadvantageous in that the productivity is considerably inferior because of the increased production steps. In addition, since no simultaneous imparting of the pattern to the top face and to the front side face can be done, there is a possibility that an error may occur in the combination of the top face pattern and the front side face pattern both required in one key cap.

SUMMARY OF THE INVENTION

The inventors of the present invention have conducted a series of experiments and examination in light of the above described problems and have successfully developed the present invention. A method of making a key cap having a pattern of characters and/or symbols on its top face and its front side face according to the present invention comprises, (1) a step of fixing, under tension above the key cap, a transfer sheet in which a top face pattern and a front side face pattern are formed in paired fashion by the use of an ink containing thermally migrateable dyes and in which a line of fracture is provided around the front side face pattern at least excluding an area lying between the front side face pattern and the top face pattern, (2) a step of pressing and tightly applying the transfer sheet to the top face of the key cap with the use of a top pad, (3) a step of tightly applying the front side face pattern to the front side face of the key cap by pressing the transfer sheet against the front side face of the key cap with the use of a side pad to cause the transfer sheet to bend at the area between the top face pattern and the front side face pattern, (4) a step of dyeing by causing the thermally migrateable dyes of the transfer sheet upon heating to thermally migrate to the top face and the front side face of the key cap, and (5) a step of removing the transfer sheet which has been used.

Also, a machine for imparting a pattern of characters and/or symbols to the top face and the front side face of the key cap according to the present invention comprises a body, a main shaft, an auxiliary shaft and a return mechansim, said body supporting the main shaft, the auxiliary shaft, and a return means, said main shaft having a top pad at a tip thereof and movable up and down within the body, said auxiliary shaft having a side pad at a tip thereof and movable in a direction towards the main shaft from lateral direction in response to elevation of the main shaft, and said return mechanism being operable to act in a direction reverse to the directions of movement of the main shaft and the auxiliary shaft when the main shaft elevates and the auxiliary shaft moves towards the main shaft.

BRIEF DESCRIPTION OF THE DRAWINGS

The details of the construction of the present invention will be hereinafter described with reference to the drawings.

The drawings illustrate one embodiment of the present invention, wherein

FIG. 2 is a longitudinal sectional view of a pattern imparting machine according to the present invention, wherein FIG. 2(A) is a view of a condition before a body descends and FIG. 2(*b*) is a view of a condition after the body has descended.

DETAILED DESCRIPTION OF PREFERRED EMBODIMENTS

Figure 1:
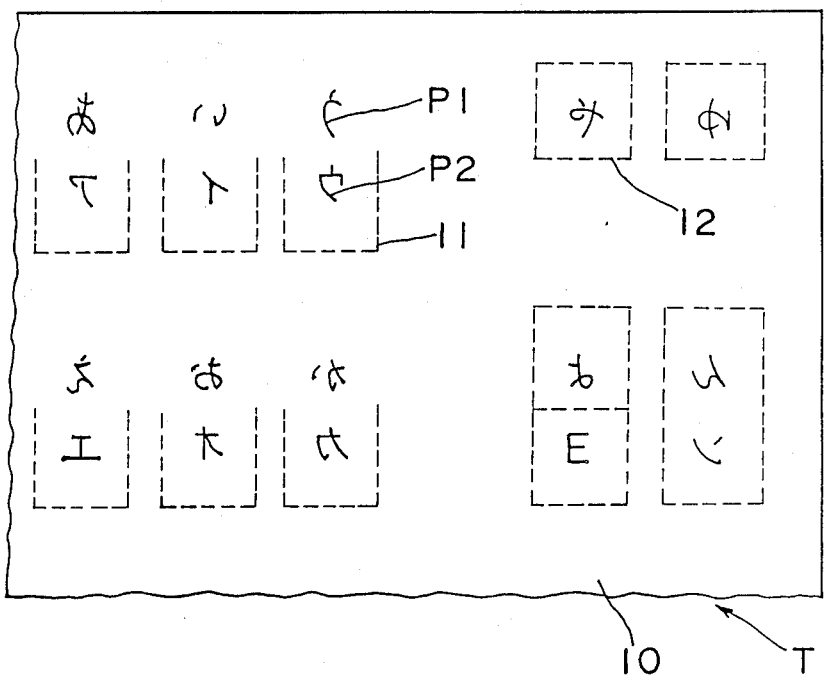
FIG. 1 is a plan view of a transfer sheet used in the present invention.
Figure 1:
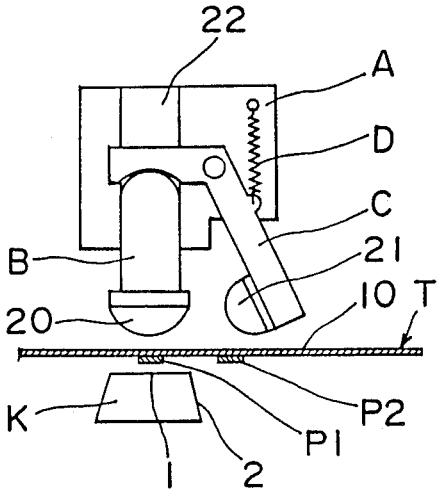
Figure 1:
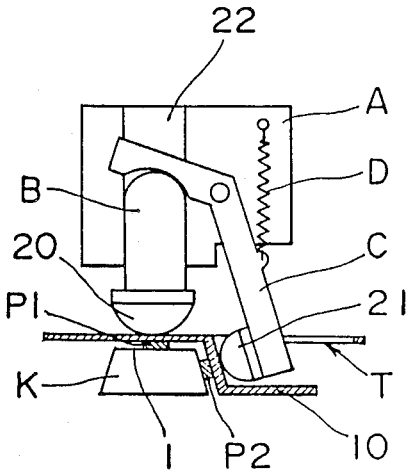

Examples of material for a plastic molded article which will become a key cap include plastic capable of being dyed with thermally migrateable dyes such as, polybutylene terephthalate, polyethylene terephthalate, polycarbonate, triacetate, diacetate, polyether salfone, aromatic nylon, 6,6-nylon and others, and a metal or the like having a surface coated with said plastics. With respect to the shape thereof, it may not only have a flat top face, but also have a concave or convex top face. When applying the method of the present invention, a key cap matrix K of such a material and such a top face shape is arranged within a key cap fixing jig (not shown) with the top face 1 oriented downwards.

A transfer sheet T used in the present invention includes patterns of characters and/or symbols formed on a support sheet 10. Examples of the support sheet 10 include sheet-like materials normally used in a transfer sheet, for example, non-coated papers such as medium-quality papers, high-quality papers and kraft papers, a metallic foil such as an aluminum foil, and heat-resistant plastic films such as polybutylene terephthalate film, polyethylene terephthalate film, polyvinyl chloride film and nylon film, and a laminate of these.

The pattern of characters and/or symbols is formed by printing with use of an ink containing the thermally migrateable dyes. The thermally migrateable dyes are of a type capable of being thermally diffused during a heat treatment as will be described later to dye a surface of the key cap matrix K. Examples of the thermally migrateable dyes include dispersed dyes, oil soluble dyes, basic dyes and others. The patterns of characters and/or symbols are formed in pairs consisting of a top face pattern P1 and a front side face pattern P2. In this case, both of the top face pattern P1 and the front side face pattern P2 may be constituted in multi-color. The transfer sheet T is provided with a line of fracture 11 around the front side face pattern P2 at least excluding an area lying between the front side face pattern P2 and the top face pattern P1. This line of fracture 11 is cut by a side pad 21 during a transfer printing to enable the front side face pattern P2 to be tightly applied to a predetermined position of a front side face 2 of the key cap matrix K.

The transfer sheet T used in the present invention should satisfy the foregoing requirements. If these requirements are satisfied, the transfer sheet T may be formed with other patterns or other lines of fracture (See FIG. 1). By way of example, a transfer sheet having only the top face pattern P1 with a front side face pattern P2, or one in which a line of fracture 12 is also provided around the top face pattern P1, may be used. If the line of fracture 12 is provided around the top face pattern P1, it is effective in the case where a top face 1 of the key cap matrix K is of a concave shape. In such a case, during the transfer printing, a top pad 20 can cut along the line of fracture 12 to facilitate the tight contact of the top face pattern P1 to the top face 1. Both of the lines of fracture 11 and 12 are constituted by a line of half-cut or a line of perforations. The line of half-cut means a line of cut formed deep in the support sheet about half the thickness thereof across the thickness of the support sheet, whereas the line of perforations means a series of holes extending completely through the thickness of the support sheet.

At a predetermined position above the top face 1 of the key cap matrix K, the transfer sheet T is fixed under stretched condition by a transfer sheet fixing frame (not shown) with the side of the patterns of characters and/or symbols oriented downwardly.

Both the top pad 20 and the side pad 21 used in the present invention have an elastic body such as a silicone rubber having a hardness of, for example, 5 to 50 degrees or the like. The top pad 20 is operable to press the transfer sheet T against the top face 1 of the key cap matrix K for a tight contact. Also, the side pad 21 is operable to press the transfer sheet T against the front side face 2 of the key cap matrix K to cause the transfer sheet T to bend at the area between the top face pattern P1 and the front side face pattern P2 and also to cut along the line of fracture 11 to allow the front side face pattern P2 to be tightly applied to the front side face 2. The shape of each of the top pad 20 and the side pad 21 is preferably in accord with the shape of the top face 20 or the front side face 21, respectively, of the key cap matrix K. By way of example, where the top face 1 of the key cap matrix K is of a concave shape, it is preferred that the top part 20 be made in a convex shape having a radius of curvature somewhat smaller than the radius of curvature of that portion. By so doing, air between the transfer sheet T and the top face 1 of the key cap matrix K can be removed and a complete tight contact between the both can be attained.

Then, a heating condition is adopted by selecting a temperature and a time required for the thermally migrateable dyes to migrate by thermal diffusion to the top face 1 and the front side face 2. Accordingly, the condition therefor varies depending on the kind of the thermally migrateable dyes used and the type of material for the key cap matrix K. As a heating method, there is (1) a method wherein the key cap matrix K is heated before the transfer sheet T is tightly applied to the key cap matrix K, (2) a method wherein, after the transfer sheet T has been tightly applied to the key cap matrix K, it is left in a heated atmosphere in the form as it is, (3) a method wherein, at the time the transfer sheet T is applied to the key cap matrix K, the top pad 20 and the side pad 21 are heated, and others. Of them, a method according to a combination of (1) and (3) is most preferred because a sufficient heat can be efficiently imparted to the key cap matrix K and because a continuous operation is possible. The heating condition and the dyeing mechanism in this case are as follows. Assuming that the distance from a heating source to a surface of the key cap matrix K is 30 to 500 mm, the key cap matrix K is heated for 50 to 360 seconds by a electromagnetic wave of 1.5 to 1,000 μm, particularly 4 to 50 μm, in wavelength, to about 150° to 230° C. The transfer sheet T is tightly applied to the top face 1 and to the front side face 2 of the key cap matrix K by the use of the top pad 20 and the side pad 21 which have been heated by a heater to 100° to 200° C. When this is done, the thermally migrateable dyes within the patterns of the transfer sheet T are activated by the heat of the key cap matrix K, and, when this condition is maintained for a predetermined time (t to 60 seconds), the thermally migrateable dyes migrate to the top face 1 and the front side face 2 of the key cap matrix to form a desired pattern.

Finally, by removing the transfer sheet T which has been used, the key cap having the patterns of characters and/or symbols on the top and front side faces according to the present invention is obtained. The top face pattern P1 and the front side face pattern P2 are accurately imparted to predetermined positions.

In order for the method of the present invention to be practised industrially, it is preferred to simultaneously apply to a plurality of key caps required for each set of keyboard portions. In this case, where the set of the keyboard portions consist of key caps which require the pattern of characters and/or symbols to be imparted only on the top face 1, it is advisable to use both the top pad 20 and the side pad 21 for the former and to use only the top pad 20 for the latter.

Hereinafter, a pattern imparting machine utilizeable in a transfer apparatus in which the method of making plastic molded articles having patterns of characters and/or symbols on the top and front side faces according to the present invention is systematized will be described in connection with an example thereof with reference to the drawing. With respect to a basic structure of the transfer apparatus, what is described in, for example, the Japanese Laid-open Patent Publication No. 59-157820 and the European Patent Application No. 84111503.3 can be applicable.

The pattern imparting machine accoring to the present invention is constituted by a body A, a main shaft B, an auxiliary shaft C and a return mechanism D.

The body A supports the main shaft B, the auxiliary shaft C and the return mechanism D. And, this body A is rendered movable up and down when incorporated in the transfer apparatus. It is to be noted that, industrially, when the body A is incorporated in the transfer apparatus, it is designed to cause a plurality of bodies A to move simultaneously.

The main shaft B has the top pad 20 at its tip and is movable up and down within the body A. An upper portion of the main shaft B is arranged within a slide hole 22 provided within the body A and descends together therewith, when the body A descends, to permit the top pad 20 to abut the top face 1 of the key cap matrix K positioned therebelow, the top pad 20 being brought into tight contact with the top face 1 due to a descending force being further applied. At this time, the main shaft B elevates relative to the body A.

The auxiliary shaft C has the side pad 21 at its tip and is movable in a direction towards the main shaft B in a lateral direction in response to the elevation of the main relative to the body A shaft B. In FIG. 2, the auxiliary shaft C is in the form as bend, and the bent is journalled with the body A. It is so constructed that, when the main shaft B descends as a result of the descent of the body A with the top pad 20 at the tip thereof brought into tight contact with the top face 1, an upper portion of the auxiliary shaft C can be kicked by the elevation of the main shaft B. Accordingly, a lower portion of the auxiliary shaft C moves towards the main shaft B in a lateral direction in unison with the movement thereof to abut against the front side face 2 of the key cap matrix K, the side pad P2 being brought into tight contact with the front side face 2 due to a descending force being further applied to the body A.

The return mechanism D is operable to act in a direction reverse to the directions of movement of the main shaft B and the auxiliary shaft C when the main shaft B elevates and the auxiliary shaft C moves towards the main shaft B.

The pattern imparting machine according to the present invention is not limited to that described in Fig. 2, but may include numerous modes of embodiment. By way of example, with respect to the relationship between the main shaft B and the auxiliary shaft C, a pinion-and-rack mechanism may be employed instead of a mechanism shown in FIG. 2.

It is to be noted that, since movable parts become high in temperature, lubrication is a dry lubrication, and even in the case of wet lubrication, it is necessary to construct in such a way that no oil will drop onto the key cap surface when at an elevated temperature.

The method of making the plastic molded articles having the patterns of characters and/or symbols on the top and front side faces according to the present invention has the following effects. Since the heat treatment is effected while the top and front side faces of the plastic molded articles have been tightly applied with the top face and front side face patterns of the transfer sheet, the plastic molded articles having the patterns of characters and/or symbols on the top and front side faces can be manufactured with good productivity and at inexpensive cost. Moreover, since the top and front side face patterns which have been formed on the transfer sheet are simultaneously printed on the top and front side faces of the plastic molded articles, any misprint in combination of characters for the top face and characters for the front side face can be completely avoided.

Furthermore, since the pattern imparting machine according to the present invention is of a continuous drive structure, the patterns of characters and/or symbols can be imparted to the top and front side faces of the plastic molded articles with good productivity and at inexpensive cost.

Although only preferred embodiments are specifically illustrated and described herein, it will be appreciated that many modifications and variations of the present invention are possible in light of the above teachings and within the purview of the appended claims without departing from the spirit and intended scope of the invention.

We claim:

1. A method of making a plastic molded article having a pattern of characters and/or symbols on its top face and its front side face, comprising:

positioning, under tension and above the plastic molded article, a transfer sheet in which a top face pattern and a front side face pattern are formed in paired fashion by the use of a thermally diffusable dye and in which sheet a line of fracture is provided around a portion of the front side face pattern, said portion excluding an area sufficient to maintain a connection between the portion of the transfer sheet containing the top face pattern and the portion of the transfer sheet containing the front side face pattern, pressing a top pad onto the transfer sheet so as to tightly apply the portion of the transfer sheet having the top face pattern to the top face of the plastic molded article, pressing a side pad onto the transfer sheet so as to tightly apply the portion of the transfer sheet having the front side face pattern to the front side face of the plastic molded article to cause the transfer sheet to bend at an area between the top face pattern and the front side face pattern, heating the transfer sheet to so as cause the thermally diffusable dyes of the transfer sheet to thermally diffuse to the top face and the front side face of the plastic molded article, and removing the transfer sheet from the plastic molded article.

2. The method of claim 1, wherein the step of heating the transfer sheet includes heating the plastic molded article before the transfer sheet is tightly applied.

3. The method of claim 1, wherein the step of heating the transfer sheet includes maintaining the plastic molded article with the transfer sheet tightly applied thereto in a heated atmosphere.

4. The method of claim 1, wherein the step of heating the transfer sheet includes heating the top pad and side pad prior to pressing them against the transfer sheet.

5. The method of claim 1, wherein the step of heating the transfer sheet includes heating the plastic molded article, the top pad, and the side pad before the transfer sheet is applied to the plastic molded article.

6. The method of claim 2, wherein the plastic molded article is heated by an electromagnetic wave of 1.5 to 1000 μm for 50 to 360 seconds.

7. The method of claim 4, wherein the top pad and side pad are heated to 100°-200° C.

8. The method of claim 1, wherein the step of positioning the transfer sheet above the plastic molded article includes mounting the transfer sheet in a frame.

9. The method of claim 1, wherein the line of fracture in the transfer sheet constitutes a cut extending into the transfer sheet for about half the thickness of the transfer sheet.

10. The method of claim 1, wherein the line of fracture in the transfer sheet constitutes a series of perforations extending completely through the transfer sheet.

* * * * *